US008011653B2

(12) United States Patent
Mayne

(10) Patent No.: US 8,011,653 B2
(45) Date of Patent: Sep. 6, 2011

(54) SHEET-FEEDING DEVICE AND METHOD OF FEEDING SHEET MEDIA

(75) Inventor: Doug Mayne, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 326 days.

(21) Appl. No.: 11/796,287

(22) Filed: Apr. 27, 2007

(65) Prior Publication Data

US 2008/0265492 A1 Oct. 30, 2008

(51) Int. Cl.
*B65H 3/06* (2006.01)

(52) U.S. Cl. ..... 271/117

(58) Field of Classification Search ..... 271/117, 271/118

See application file for complete search history.

(56) References Cited

U.S. PATENT DOCUMENTS 1,165,521 A * 12/1915 Lockton ..... 271/111
1,918,460 A * 7/1933 Eccardt ..... 221/23
4,363,477 A 12/1982 Miyashita
4,372,547 A 2/1983 Yanagawa et al.
4,395,032 A 7/1983 Hipp, Jr.
4,456,235 A * 6/1984 Colglazier et al. ..... 271/3.08
4,984,778 A 1/1991 Alexander et al.
4,995,601 A 2/1991 Ohashi et al.
5,106,072 A 4/1992 Sugiura et al.
5,234,208 A * 8/1993 Bandura et al. ..... 271/34
5,324,015 A 6/1994 Freitag
5,704,608 A * 1/1998 Petocchi ..... 271/116
6,227,533 B1 5/2001 Jang
6,349,193 B1 * 2/2002 Matayoshi ..... 399/388
6,866,259 B2 3/2005 Underwood et al.
7,004,460 B2 2/2006 Ruhe et al.
7,410,159 B2 * 8/2008 Miyazaki et al. ..... 271/110
2002/0057466 A1 * 5/2002 Nose et al. ..... 358/498
2004/0017038 A1 1/2004 Underwood et al.

FOREIGN PATENT DOCUMENTS

JP 04173632 A * 6/1992

* cited by examiner

*Primary Examiner* — Michael C McCullough

(57) ABSTRACT

A sheet-feeding device includes a tray for holding sheet media of various widths and a shaft extending across the tray. A plurality of pick assemblies is mounted to the shaft. The pick assemblies are spaced along the shaft so that one or more of the pick assemblies contact sheet media in the tray depending on the width of the sheet media. Furthermore, the spacing of the pick assemblies is such that the pick assemblies in contact with the sheet media define a total offset relative to the centerline of the sheet media that is sufficiently small enough to avoid skewing of sheet media for a variety of different media widths.

16 Claims, 4 Drawing Sheets

SHEET-FEEDING DEVICE AND METHOD OF FEEDING SHEET MEDIA

BACKGROUND OF THE INVENTION

Hardcopy devices, such as copiers, printers, facsimile machines, multi-function devices (MFD), and the like, are widely used for producing hard copy documents on print media such as such as paper, card stock, transparencies, envelopes, labels and the like. Such hardcopy devices typically include a mechanism configured to pick an individual sheet of media from a stack of media held in an input tray and transport the sheet to a media feed path in the hardcopy device. One commonly used pick mechanism is the swing arm pick mechanism. In a swing arm pick mechanism, a driven pick roller or tire is mounted to the end of a swing arm that pivots or "swings" above the media input tray. The pick roller rests on top of the stack of media sheets in the tray. A biasing force applied to the swing arm urges the pick roller in contact with the topmost sheet in the tray, thereby creating friction between the pick roller and the topmost sheet. When rotated, the pick roller picks the topmost sheet and advances it to the media feed path.

Many hardcopy devices are capable of handling a variety of media sizes. Thus, media input trays are often designed to accommodate multiple media sizes, such as letter, legal, and A4 paper sizes, as well as a range of envelope and label sizes. In hardcopy devices that utilize a swing arm pick mechanism, the swing arm assembly is generally located to one side of the input tray to accommodate different sizes of media. For many media sizes, the pick roller is thus offset with respect to the centerline of the media. Because the pick roller contacts and drives the media from an off-center position, the driving force is applied to one side of the media sheet. This unbalanced driving force tends to cause the media sheet to enter the media feed path at an angle. This results in a skewing error that can lead to printing errors, such as poor margin control and crooked print, or media feed errors, such as paper damage and jams.

DETAILED DESCRIPTION OF THE INVENTION

The present invention relates to a sheet-feeding device for delivering individual sheets from a stack of sheet media to the internal media feed path of a hardcopy device such as a copier, printer, facsimile machine, multi-function device (MFD) or the like. Generally, the sheet-feeding device includes an input tray for holding a stack of sheet media and a means for picking an individual sheet from the stack of sheet media and transporting the sheet to the internal media feed path.

Figure 1:
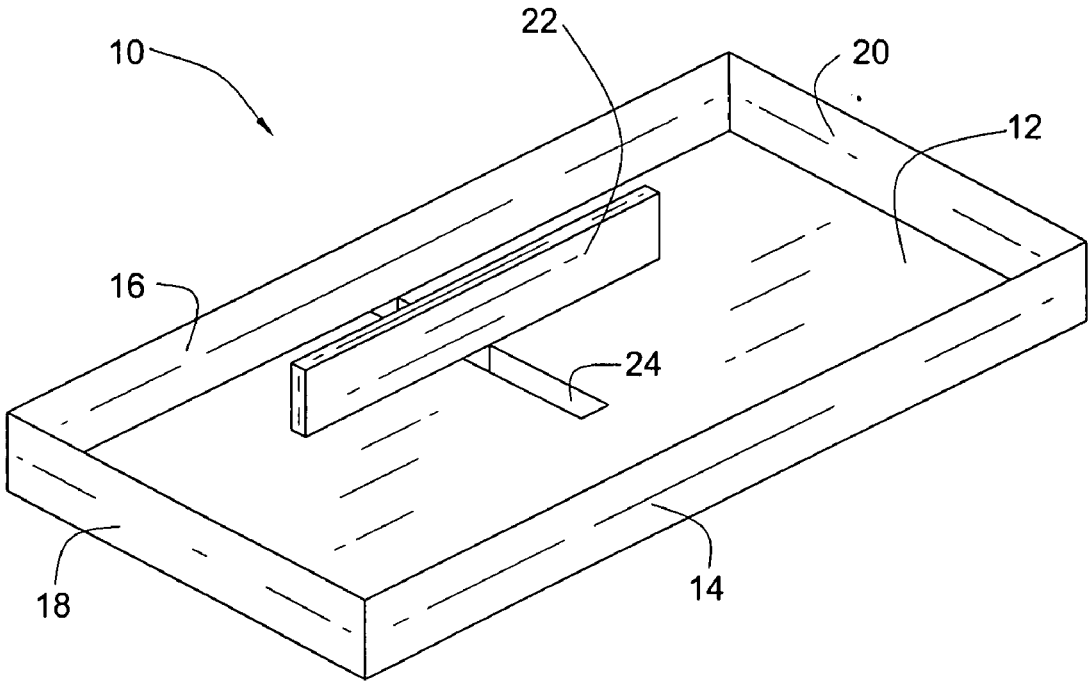
FIG. 1 is an isometric view of one embodiment of an input tray.

FIG. 1 shows a representative input tray 10 for holding a stack of sheet media. The input tray 10 comprises a generally rectangular base 12, first and second side walls 14, 16 extending upwardly from the base 12, and first and second end walls 18, 20 also extending upwardly from the base 12. A stack of media sheets (not shown in FIG. 1) is received in the space defined by the base 12, first sidewall 14, second sidewall 16, first end wall 18, second end wall 20. The first side wall 14 functions as a fixed media guide or datum that one side of the stack of media sheets abuts when stored in the tray 10. The input tray 10 also includes a width adjuster 22 that abuts the other side of the media stack. The width adjuster 22 is moveable for adjusting the width of the media receiving space in the tray 10 to accommodate different width media. In the illustrated embodiment, the width adjuster 22 comprises a thin, flat strip of material disposed parallel to the first and second side walls 14, 16 that slides in a slot 24 formed in the base 12 for adjusting the distance between the width adjuster 22 and the first side wall/fixed media guide 14 to accommodate different width media. When the width adjuster 22 is set properly for a given media width, the stack of media sheets fit snugly between the first side wall/fixed media guide 14 and the width adjuster 22. The input tray 10 can also include a similar length adjuster (not shown).

FIGS. 2-7 show one embodiment of a sheet-feeding device 26 including the input tray 10 having a stack of sheet media 27 stored therein. The sheet-feeding device 26 includes a chassis 28 comprising two frame members 30 spaced apart to receive the input tray 10 therebetween. The frame members 30 are connected by a cross bar 32 that extends across the top of the input tray 10. A shaft 34 extends between the two frame members 30, with each end of the shaft 34 being rotatively mounted to a corresponding one of the frame members 30. The shaft 34 extends across the top of the input tray 10, near the cross bar 32, and perpendicular to the sidewalls 14, 16 of the input tray 10 and the centerline of the sheet media. A motor 36 is provided for rotatively driving the shaft 34.

A plurality of pick assemblies 38*a*, 38*b*, 38*c* are mounted on the shaft 34. The illustrated embodiment includes first, second and third pick assemblies 38*a*, 38*b*, 38*c*, although it should be noted that the present invention is not limited to three pick assemblies. Each pick assembly includes a swing arm 40 that is pivotally mounted at a first end thereof to the shaft 34. A pick roller 42 is rotatively mounted to the opposite, distal end of the swing arm 40. The pick roller 42 is preferably made of, or coated with, a rubber or other suitable friction-inducing material to assist in picking sheets of media. The swing arm 40 is biased downwardly with a suitable resilient mechanism such as a spring (not shown) so that the pick roller 42 is urged against topmost media sheet held in the input tray 10. A first pulley 44 is fixedly connected to the shaft 34, adjacent to the swing arm 40, for rotation with the shaft 34. A second pulley 46 is fixedly connected to pick roller 42, extending laterally beyond the swing arm 40, for rotation with pick roller 42. A drive belt 48 connects the first and second pulleys 44, 46 such that when the motor 36 causes the shaft 34, and thus the first pulley 44, to rotate, the rotary motion is transmitted to the pick roller 42 via the drive belt 48 and the second pulley 46. The rotating pick roller 42, when in contact with the topmost sheet of the media stack 27, picks the topmost sheet and advances it in the media feed direction depicted by arrow A.

The pick assemblies 38*a*, 38*b*, 38*c* are positioned along the length of the shaft 34, and therefore a respective distance from the first side wall/fixed media guide 14, in such a manner that the sheet-feeding device 26 can feed media sheets of differing widths to the internal media feed path of a hardcopy device without skewing. That is, the spacing of the pick assemblies 38*a*, 38*b*, 38*c* relative to the fixed first side wall/fixed media guide 14 is such that—for a variety of different media widths—the total offset with respect to the sheet media centerline of the pick assemblies in contact with the topmost media sheet is sufficiently small enough to avoid skewing of sheet media being fed to the internal media feed path. The sheet media centerline refers to the centerline of sheet media in the input tray 10 that is parallel to media feed direction A. As used herein, the term "total offset" refers to the combined offset with respect to the sheet media centerline of the pick assemblies in contact with the sheet media. For example, if two pick assemblies are in contact with the sheet media, one being offset two inches to the right of the sheet media centerline and the other being offset three inches to the left of the sheet media centerline, then the total offset would be one inch. Then again, if one of the two pick assemblies is offset two inches to the right of the sheet media centerline and the other is offset two inches to the left of the sheet media centerline, then the total offset would be zero. In the case where a single pick assembly is in contact with the sheet media, then the total offset is the offset of that pick assembly with respect to the sheet media centerline.

In the illustrated embodiment, the centerline of the first pick assembly 38*a* (defined by the longitudinal centerline of its swing arm 40) is located a first distance $d_1$ from the first side wall/fixed media guide 14. The centerline of the second pick assembly 38*b* is located a second distance $d_2$ from the first side wall/fixed media guide 14, wherein the second distance $d_2$ is greater than the first distance $d_1$. The centerline of the third pick assembly 38*c* is located a third distance $d_3$ from the first side wall/fixed media guide 14, wherein the third distance $d_3$ is greater than the second distance $d_2$. As will be described in more detail below, the distances $d_1$, $d_2$ and $d_3$ are set so that different width media could be engaged by one or more of the pick assemblies 38*a*, 38*b*, 38*c* and advanced without skewing.

Figure 2:
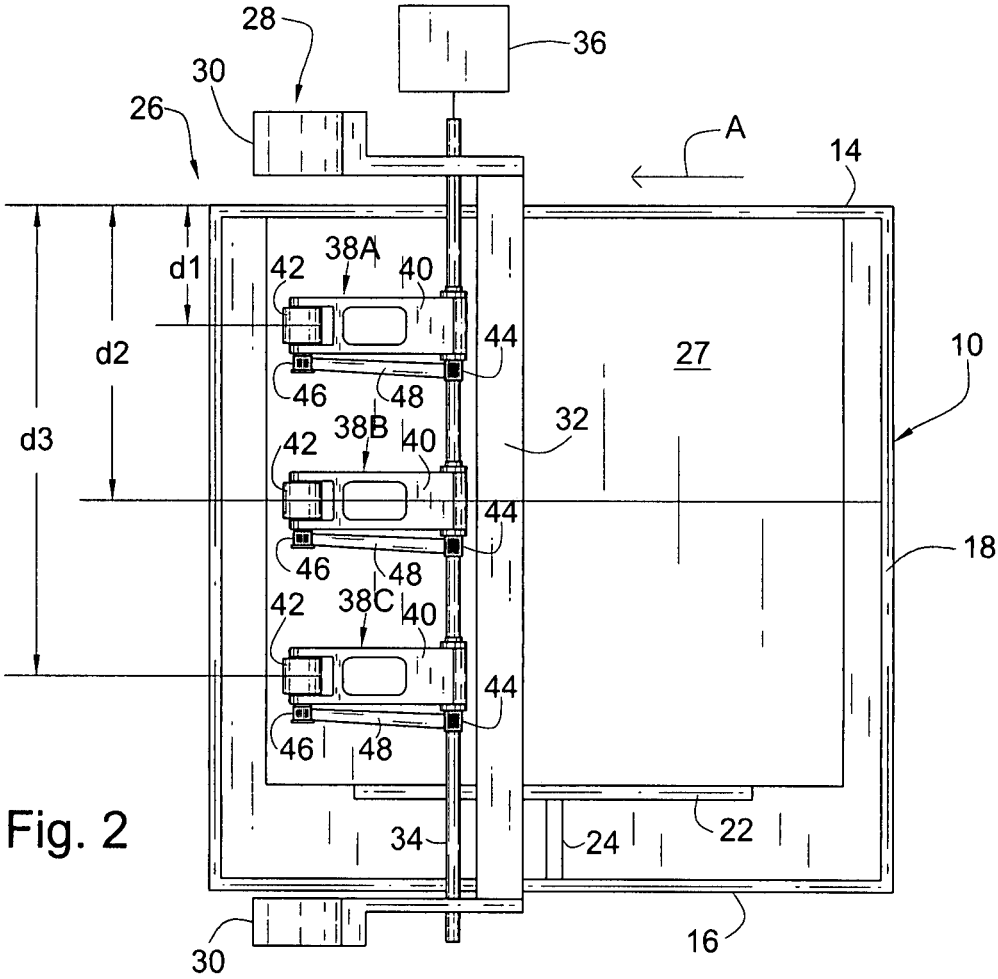
FIG. 2 is a top view of one embodiment of a sheet-feeding device loaded with sheet media having a first width.
Figure 3:
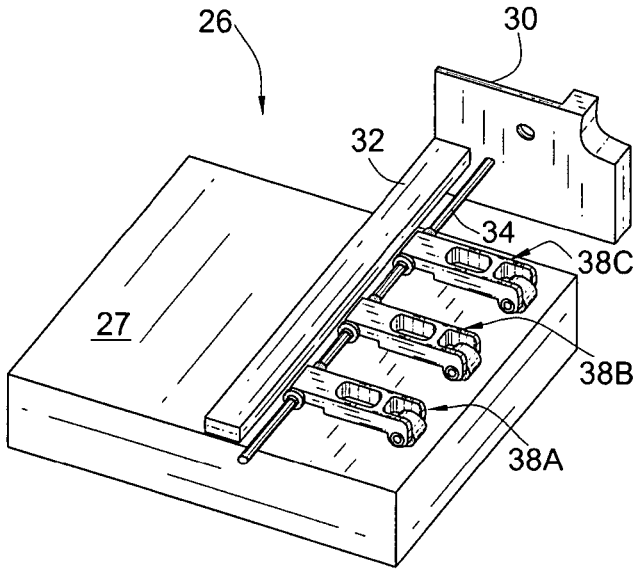
FIG. 3 is an isometric view of the sheet-feeding device of FIG. 2 having tray and other structure omitted for clarity of illustration.
Figure 4:
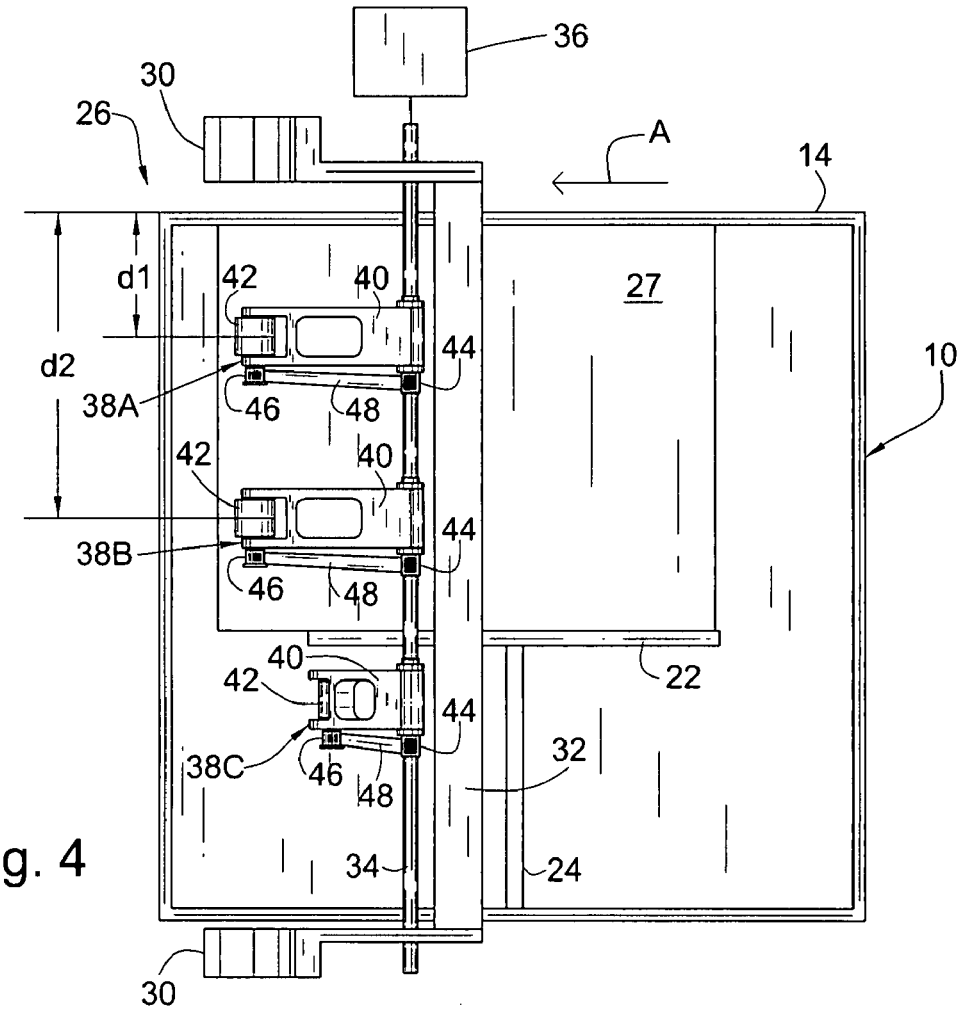
FIG. 4 is a top view of the sheet-feeding device loaded with sheet media having a second width.
Figure 5:
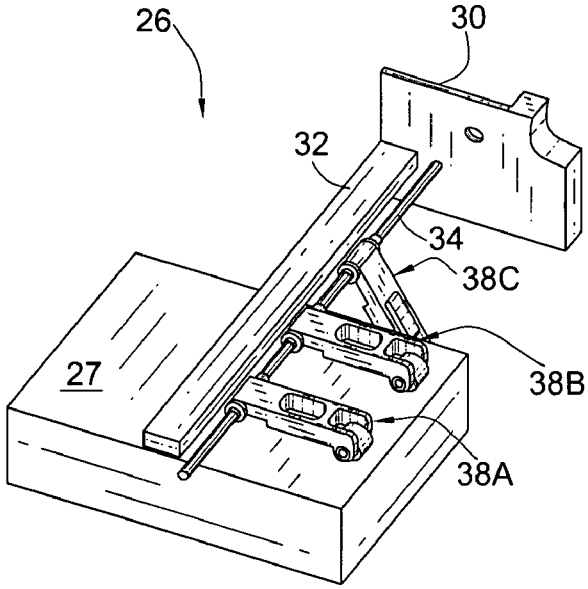
FIG. 5 is an isometric view of the sheet-feeding device of FIG. 4 having tray and other structure omitted for clarity of illustration.
Figure 6:
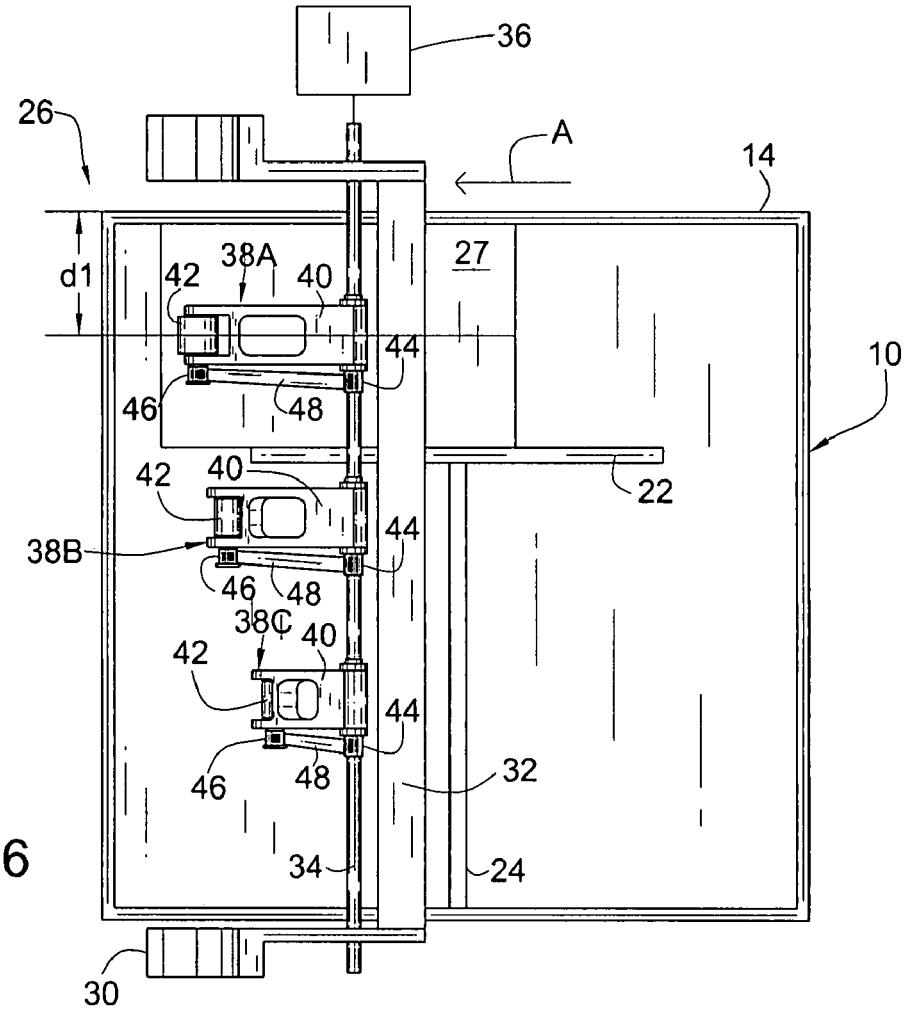
FIG. 6 is a top view of the sheet-feeding device loaded with sheet media having a third width.
Figure 7:
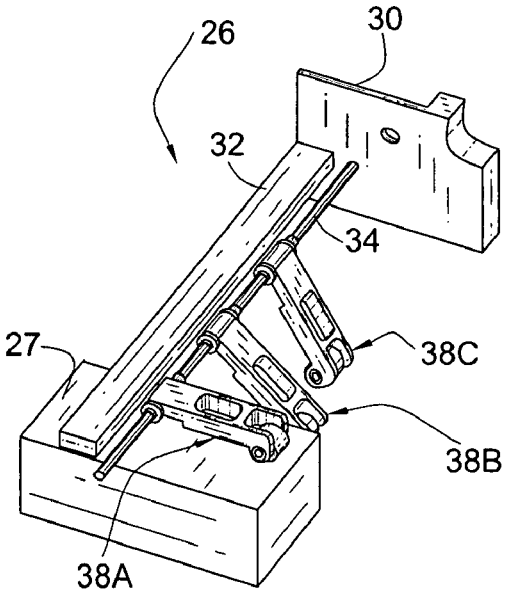
FIG. 7 is an isometric view of the sheet-feeding device of FIG. 6 having tray and other structure omitted for clarity of illustration.

With this arrangement, not all of the pick assemblies 38*a*, 38*b*, 38*c* will necessarily contact the stack of sheet media 27, depending on the width of the media sheets placed in the input tray 10. By way of example, FIGS. 2 and 3 show a stack 27 of relatively wide media sheets wherein each of the first, second and third pick assemblies 38*a*, 38*b*, 38*c* contacts the sheet media. FIGS. 4 and 5 show a stack 27 of intermediate width media sheets wherein the first and second pick assemblies 38*a*, 38*b* contact the sheet media, but the third pick assembly 38*c* does not. FIGS. 6 and 7 show a stack 27 of narrow width media sheets wherein the first pick assembly 38*a* contacts the sheet media, but the second and third pick assemblies 38*b*, 38*c* do not.

When the wide sheet media is loaded in the input tray 10, as shown in FIGS. 2 and 3, the centerline of the second pick assembly 38*b* lines up with sheet media centerline. In other words, the second pick assembly 38*b* contacts the sheet media at its centerline. The first and third pick assemblies 38*a*, 38*c* are then located on opposing sides of the sheet media centerline, with their respective centerlines being equidistant from the sheet media centerline. Another way of describing the relative spacing of the pick assemblies 38*a*, 38*b*, 38*c* is that the distance $d_2$ is equal to one-half of the width of the wide sheet media, and the difference of the distance $d_2$ and the distance $d_1$ is equal to the difference of the distance $d_3$ and the distance $d_2$. Consequently, the total offset of the three pick assemblies 38*a*, 38*b*, 38*c* with respect to the sheet media centerline is zero. This results in balanced driving forces acting on the topmost sheet while it is being picked, and balanced driving forces prevents skewing of the fed sheet.

Note that for minor width variations in the wide sheet media, the second pick assembly 38*b* would be just slightly offset from sheet media centerline. In this case, the second pick assembly 38*b* contacts the sheet media substantially at its centerline and the first and third pick assemblies 38*a*, 38*c* contact the sheet media substantially equidistant from the sheet media centerline. The total offset of the three pick assemblies 38*a*, 38*b*, 38*c* with respect to the sheet media centerline, while not being zero, would be a minimal value. This means that the driving forces acting on the sheet being fed are only slightly unbalanced; as long as the width variations are small enough, the resulting unbalance will be small enough to avoid skewing of the fed sheet.

When the intermediate width sheet media is loaded in the input tray 10, as shown in FIGS. 4 and 5, the distance of the third pick assembly 38*c* from the first side wall/fixed media guide 14 is greater than the width of the sheet media so that the third pick assembly 38*c* does not contact the sheet media. Because the pick assemblies are mounted to freely pivot about the shaft 34 independently of one another, the third pick assembly 38*c* pivots downward to an inactive position. Typically, an opening (not shown) is located in the base 12 of the input tray 10 to receive the pick roller 42 and thereby avoid damage to the pick roller 42 when the third pick assembly 38*c* is in the inactive position. The first and second pick assemblies 38*a*, 38*b* contact the sheet media on opposing sides of the sheet media centerline, with their respective centerlines being equidistant from the sheet media centerline. In this case, the difference of the distance $d_2$ and one-half of the width of the intermediate sheet media is equal to the difference of the intermediate sheet media and the distance $d_1$. Consequently, the total offset of the active first and second pick assemblies 38*a*, 38*b* with respect to the sheet media centerline is zero. This results in balanced driving forces acting on the topmost sheet while it is being picked, and balanced driving forces prevents skewing of the fed sheet. Again, minor width variations of the sheet media can be accommodated, with the width variations resulting in negligible total offset that still avoids skewing of the fed sheets.

When the narrow width sheet media is loaded in the input tray 10, as shown in FIGS. 6 and 7, the distances of the second and third pick assemblies 38*b*, 38*c* from the first side wall/fixed media guide 14 are greater than the width of the sheet media so that the second and third pick assemblies 38*b*, 38*c* do not contact the sheet media and assume inactive positions. The first pick assembly 38*a* contacts the sheet media at its centerline (i.e., the centerline of the first pick assembly 38*a* lines up with sheet media centerline). In other words, the distance $d_1$ is equal to one-half of the width of the narrow sheet media. Consequently, the total offset of the first pick assembly 38*a*, the only assembly contacting the sheet media, is zero. This results in a balanced driving force acting on the topmost sheet while it is being picked, and balanced driving force prevents skewing of the fed sheet. Again, minor width variations of the sheet media can be accommodated, with the width variations resulting in negligible total offset that still avoids skewing of the fed sheets.

While specific embodiments of the present invention have been described, it should be noted that various modifications thereto can be made without departing from the spirit and scope of the invention as defined in the appended claims.

What is claimed is:

1. A sheet-feeding device comprising:

a tray for holding sheet media of various widths;

a shaft extending across said tray; and a plurality of pick assemblies mounted to said shaft, a first end of each of said plurality of pick assemblies mounted to freely pivot about said shaft independently of one another, and said plurality of pick assemblies being spaced along said shaft so that a second end of at least one of said plurality of pick assemblies contacts sheet media in said tray depending on the width of said sheet media, and so that a total offset of pick assemblies in contact with said sheet media relative to a centerline of said sheet media is sufficiently small enough to avoid skewing of sheet media for a variety of different media widths, wherein said first end of each of said plurality of pick assemblies is upstream of said second end relative to a feed direction of said sheet media, wherein when sheet media having a first width is loaded in said tray, one of said pick assemblies contacts said sheet media substantially at a centerline of said sheet media and two other of said pick assemblies contact said sheet media on opposing sides of said sheet media centerline, substantially equidistant from said sheet media centerline.

2. The sheet-feeding device of claim 1 wherein each pick assembly comprises:

a swing arm pivotally mounted at a first end thereof to said shaft;

a pick roller rotatively mounted to a second end of said swing arm, said pick roller including a media contact surface adapted to contact and grip the sheet media; and a drive belt connected between said shaft and said pick roller adapted to transmit rotation of said shaft to said pick roller to enable said pick roller to feed the sheet media.

3. The sheet-feeding device of claim 2 wherein said swing arm includes a first leg provided on a first side of said pick roller and a second leg provided between said drive belt and said pick roller on a second side of said pick roller.

4. The sheet-feeding device of claim 2 further comprising means for rotating said shaft.

5. The sheet-feeding device of claim 1 wherein said shaft is perpendicular to said centerline of said sheet media.

6. The sheet-feeding device of claim 1 wherein when sheet media having a second width less than said first width is loaded in said tray, two of said pick assemblies contact said sheet media on opposing sides of said sheet media centerline, substantially equidistant from said sheet media centerline.

7. The sheet-feeding device of claim 6 wherein when sheet media having a third width less than said second width is loaded in said tray, one of said pick assemblies contacts said sheet media substantially at said sheet media centerline.

8. A sheet-feeding device comprising:

a tray for holding sheet media of various widths, said tray having a fixed media guide;

a shaft extending across said tray; and a first pick assembly pivotally mounted about a first end thereof to said shaft a first distance from said fixed media guide;

a second pick assembly pivotally mounted about a first end thereof to said shaft a second distance from said fixed media guide;

a third pick assembly pivotally mounted about a first end thereof to said shaft a third distance from said fixed media guide;

said pick assemblies being positioned within the sheet-feeding device wherein, in one instance, when sheet media having a first width is loaded in said tray, a second end of said second pick assembly contacts said sheet media substantially at a centerline of said sheet media and a second end of said first and third pick assemblies contacts said sheet media on opposing sides of said sheet media centerline, substantially equidistant from said sheet media centerline;

said pick assemblies being positioned within the sheet-feeding device wherein, in another instance, when sheet media having a second width less than said first width is loaded in said tray, a second end of said third pick assembly does not contact said sheet media and a second end of said first and second pick assemblies contacts said sheet media on opposing sides of said sheet media centerline, substantially equidistant from said sheet media centerline; and said pick assemblies being positioned within the sheet-feeding device wherein, in another instance, when sheet media having a third width less than said second width is loaded in said tray, a second end of said second and third pick assemblies does not contact said sheet media and a second end of said first pick assembly contacts said sheet media substantially at said sheet media centerline, wherein said first end of said pick assemblies is upstream of said second end relative to a feed direction of said sheet media.

9. The sheet-feeding device of claim 8 wherein said second distance is greater than said first distance and said third distance is greater than said second distance.

10. The sheet-feeding device of claim 9 wherein the difference between said second and first distances is substantially equal to the difference between said third and second distances.

11. The sheet-feeding device of claim 8 wherein each one of said first, second and third pick assemblies comprises:

a swing arm pivotally mounted at a first end thereof to said shaft;

a pick roller rotatively mounted to a second end of said swing arm, said pick roller including a media contact surface adapted to contact and grip the sheet media; and a drive belt connected between said shaft and said pick roller adapted to transmit rotation of said shaft to said pick roller to enable said pick roller to feed the sheet media.

12. The sheet-feeding device of claim 11 further comprising means for rotating said shaft.

13. The sheet-feeding device of claim 8 wherein said shaft is perpendicular to said fixed media guide.

14. A method of feeding sheet media to a hardcopy device without skewing, said method comprising:

providing a tray for holding sheet media of various widths;

mounting a first end of a plurality of pick assemblies to freely pivot independently of one another relative to said tray for picking sheet media from said tray;

positioning said plurality of pick assemblies relative to a centerline of sheet media loaded in said tray so that, depending on the width of said sheet media, at least one of said plurality of pick assemblies contacts sheet media in said tray with a total offset relative to said centerline of said sheet media that is sufficiently small enough to avoid skewing of sheet media for a variety of different media widths; and causing a second end of said plurality of pick assemblies in contact with said sheet media to feed a sheet of said sheet media to said hardcopy device in a feed direction, wherein said first end of said plurality of pick assemblies is upstream of said second end relative to said feed direction, wherein sheet media having a first width is loaded in said tray, and one of said pick assemblies contacts said sheet media substantially at the centerline of said sheet media and two other pick assemblies contact said sheet media on opposing sides of said sheet media centerline, substantially equidistant from said sheet media centerline.

15. The method of claim 14 wherein sheet media having a second width less than said first width is loaded in said tray, and two of said pick assemblies contact said sheet media on opposing sides of said sheet media centerline, substantially equidistant from said sheet media centerline.

16. The method of claim 15 wherein sheet media having a third width less than said second width is loaded in said tray, and one of said pick assemblies contacts said sheet media substantially at said sheet media centerline.

* * * * *